US007143576B2

(12) United States Patent
Oono

(10) Patent No.: US 7,143,576 B2
(45) Date of Patent: Dec. 5, 2006

(54) FUEL INJECTION CONTROL DEVICE OF INTERNAL COMBUSTION ENGINE

(75) Inventor: Takahiko Oono, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 112 days.

(21) Appl. No.: 11/002,270

(22) Filed: Dec. 3, 2004

(65) Prior Publication Data

US 2005/0252200 A1 Nov. 17, 2005

(30) Foreign Application Priority Data

May 12, 2004 (JP) ..... P2004-142785

(51) Int. Cl.
*F01N 3/00* (2006.01)

(52) U.S. Cl. ..... 60/285; 60/284; 60/286; 123/447; 123/458; 123/467

(58) Field of Classification Search ..... 60/274, 60/284, 285, 286, 300; 123/446, 447, 456, 123/458, 325, 332, 467
See application file for complete search history.

(56) References Cited

U.S. PATENT DOCUMENTS 6,457,453 B1 * 10/2002 Tanabe et al. ..... 123/300
6,722,345 B1 * 4/2004 Saeki et al. ..... 123/435
6,755,176 B1 * 6/2004 Takeuchi et al. ..... 123/299
6,988,487 B1 * 1/2006 Oono et al. ..... 123/447

FOREIGN PATENT DOCUMENTS

JP 2000-303883 A 10/2000

* cited by examiner

*Primary Examiner*—Binh Q. Tran
(74) *Attorney, Agent, or Firm*—Sughrue Mion, PLLC

(57) ABSTRACT

A fuel injection control device of an internal combustion engine includes fuel injection valve control means which calculates a basic fuel injection flow rate which becomes a target air-fuel ratio corresponding to an engine operation state and performs a driving control of the fuel injection valve, a fuel pressure sensor which detects a fuel pressure in the inside of the pressure storage chamber, a discharge amount control valve for controlling a fuel amount supplied to the pressure storage chamber from the high-pressure pump, and fuel pressure control means which controls the discharge amount control valve such that the fuel pressures in the inside of the pressure storage chamber agrees with a preset target fuel pressure, wherein the fuel injection control device includes fuel increase correction means which increases the basic fuel injection flow rate in a state that a rotational speed of the engine falls in a given preset rotational speed region where the minimum discharge flow rate of the high-pressure pump is expected to exceed zero and the fuel pressure in the inside of the pressure storage chamber is higher than the target fuel pressure.

18 Claims, 7 Drawing Sheets

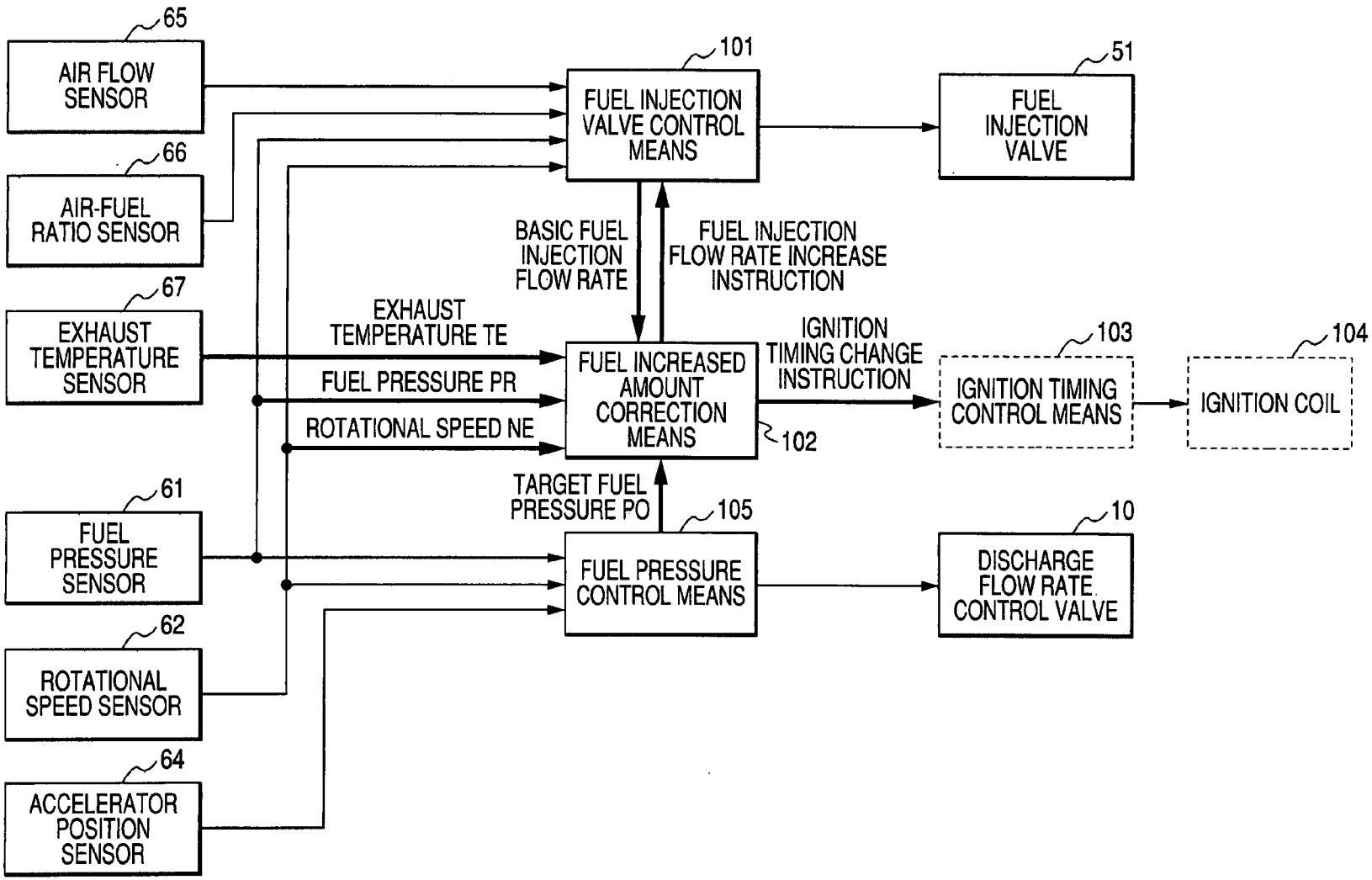
FIG. 1
101
FUEL INJECTION VALVE CONTROL MEANS
51
FUEL INJECTION VALVE
FUEL INJECTION FLOW RATE INCREASE INSTRUCTION
BASIC FUEL INJECTION FLOW RATE
102
FUEL INCREASED AMOUNT CORRECTION MEANS
IGNITION TIMING CHANGE INSTRUCTION
103
IGNITION TIMING CONTROL MEANS
104
IGNITION COIL
105
FUEL PRESSURE CONTROL MEANS
TARGET FUEL PRESSURE PO
10
DISCHARGE FLOW RATE CONTROL VALVE
EXHAUST TEMPERATURE TE
FUEL PRESSURE PR
ROTATIONAL SPEED NE
65
AIR FLOW SENSOR
66
AIR-FUEL RATIO SENSOR
67
EXHAUST TEMPERATURE SENSOR
61
FUEL PRESSURE SENSOR
62
ROTATIONAL SPEED SENSOR
64
ACCELERATOR POSITION SENSOR

FUEL INJECTION CONTROL DEVICE OF INTERNAL COMBUSTION ENGINE

BACKGROUND OF THE INVENTION

1. Field of the Invention

The present invention relates to a fuel injection control device of an internal combustion engine, and more particularly to a fuel injection control device which directly injects fuel into the inside of a combustion chamber of an engine while controlling a fuel pressure in a pressure storage chamber to a high-pressure target fuel pressure.

2. Description of the Related Art

Recently, an internal combustion engine which controls a fuel pressure in a pressure storage chamber such that the fuel pressure assumes an optimum high pressure value for a combustion state and directly injects fuel into a combustion chamber has been commercialized and one example of the constitution of a fuel supply system of this type of internal combustion engine is explained in conjunction with FIG. 4.

In FIG. 4, a high-pressure pump 20 is provided for pressurizing the fuel to a high pressure and the high-pressure pump 20 includes a cylinder 21, a plunger 22 which reciprocates in the inside of the cylinder 21, and a pressurizing chamber 23 which is defined and formed by an inner peripheral wall surface of the cylinder 21 and an upper end surface of the plunger 22. A lower end of the plunger 22 is brought into pressure contact with a cam 25 which is formed on a camshaft 24 of the engine, wherein due to the rotation of the cam 25 induced by the rotation of the camshaft 24, the plunger 22 reciprocates in the inside of the cylinder 21 thus changing a volume inside the pressurizing chamber 23.

Further, an inflow passage 30 which is connected to an upstream of the pressurizing chamber 23 is connected with a fuel tank 32 by way of a low pressure pump 31. Here, the low pressure pump 31 sucks and discharges the fuel in the fuel tank 32 and the fuel discharged from the low pressure pump 31 is regulated to a given low pressure value by a low-pressure regulator 33 and, thereafter, the fuel is introduced into the inside of the pressurizing chamber 23 by way of a check valve 34 when the plunger 22 descends in the inside of the cylinder 21.

On the other hand, a supply passage 35 which is connected to a downstream of the pressurizing chamber 23 is connected to a pressure storage chamber 50 by way of a check valve 36, wherein the pressure storage chamber 50 holds the high-pressure fuel discharged from the pressurizing chamber 23 and, at the same time, distributes the fuel into fuel injection valves 51. Further, the check valve 36 is provided for restricting the back flow of the fuel from the pressure storage chamber 50 to the pressurizing chamber 23.

Further, a relief valve 37 which is connected with the pressure storage chamber 50 is a normally-closed valve which is opened at a given valve-opening pressure or more. That is, when the fuel pressure in the inside of the pressure storage chamber 50 is elevated to the above-mentioned valve-opening pressure or more, the relief valve 37 is opened so that the fuel in the inside of the pressure storage chamber 50 is made to return to the fuel tank 32 through a relief passage 38 and hence, the excessive increase of the fuel pressure in the inside of the pressure storage chamber 50 is prevented.

A discharge flow rate control valve 10 provided between a supply passage 35 and a spill passage 39 is, for example, a normally-open electromagnetic valve. During a period in which the plunger 22 is moved upwardly in the inside of the cylinder 21, so long as a valve-opening control of the discharge flow rate control valve 10 is performed, the fuel which is discharged from the pressurizing chamber 23 to the supply passage 35 is made to return from the spill passage 39 to the inflow passage 30 so that the high-pressure fuel is not supplied to the pressure storage chamber 50. Then, after the discharge flow rate control valve 10 is closed at a given timing during the upward movement of the plunger 22 in the inside of the cylinder 21, the pressurized fuel discharged from the pressurizing chamber 23 to the supply passage 35 is supplied to the pressure storage chamber 50 through the check valve 36.

To an ECU 60 which constitutes an electronic control unit, detection signals from a rotational speed sensor 62 which detects a rotational speed of an engine 40, an accelerator position sensor 64 which detects a step-in amount of an accelerator pedal 63 and the like are inputted. The ECU 60 determines a target fuel pressure PO based on these engine operation information, and performs a feedback control of open/close timing of the discharge flow rate control valve 10 such that a fuel pressure PR detected by a fuel pressure sensor 61 which detects the fuel pressure in the inside of the pressure storage chamber 50 agrees with the target fuel pressure PO.

Further, the ECU 60 calculates a basic fuel injection flow rate which makes an air-fuel ratio detected by an air-fuel ratio sensor 66 arranged on an exhaust pipe assume a target air-fuel ratio based on an intake air flow rate detected by an air flow sensor 65, an engine rotational speed detected by the rotational speed sensor 62, the fuel pressure in the inside of the pressure storage chamber 50 detected by the fuel pressure sensor 61 and performs a drive control of the fuel injection valves 51.

Next, one example of the inner structure of the discharge flow rate control valve 10 is explained in conjunction with FIG. 5A and FIG. 5B.

To one end of a spill valve plunger 11, a spill valve 12 which is interlocked with the spill valve plunger 11 is connected, while to another end of the spill valve plunger 11, a spring 13 is connected. When a solenoid 14 is not energized, the spill valve 12 which is interlocked with the spill plunger 11 is pushed downwardly by a spring force of the spring 13 thus providing an valve opening state in which a supply passage 35 and a spill passage 39 are communicated with each other (FIG. 5A).

On the other hand, when the solenoid 14 is energized by the ECU 60, an electromagnetic force which the solenoid 14 generates overcomes the spring force of the spring 13 and attracts the spill valve plunger 11 upwardly. As a result, the spill valve 12 which is interlocked with the spill valve plunger 11 is also pulled upwardly thus providing an valve closed state in which the supply passage 35 and the spill passage 39 are—interrupted from each other (FIG. 5B).

Next, in conjunction with FIG. 6, the relationship between the manner of operation of the discharge flow rate control valve 10 and a fuel amount which is supplied from a high-pressure pump 20 to a pressure storage chamber 50 is explained.

A plunger 22 of the high-pressure pump 20 repeats the upward and downward movements between a minimum lift position and a maximum lift position in an interlocking manner with the rotation of a cam 25 of the engine 40. Then, as mentioned above, in a fuel intake stroke in which the plunger 22 descends from the maximum lift position to the minimum lift position, fuel is sucked into the inside of a pressurizing chamber 23 of the high-pressure pump 20 from an intake passage 30.

In a fuel discharge stroke in which the plunger 22 ascends from the minimum lift position to the maximum lift position, when the solenoid 14 is not energized, the discharge flow rate control valve 10 assumes a valve opening state and hence, fuel discharged from the high-pressure pump 20 is made to return to the intake passage 30 from the supply passage 35 through the spill passage 39 and the fuel is not supplied to the pressure storage chamber 50. Further, when the solenoid 14 is energized at given timing, the discharge flow rate control valve 10 assumes a valve closed state and hence, the supply passage 35 and the spill passage 39 are interrupted from each other, and the fuel which is discharged to the supply passage 35 from the pressurizing chamber 23 is supplied to the pressure storage chamber 50 during a period that the plunger 22 moves upwardly thereafter.

Due to the above-mentioned operations, to supply a portion of the fuel which the high-pressure pump 20 discharges to the pressure storage chamber 50, as indicated by a period Ta for [1] partial discharge control shown in FIG. 6, the solenoid 14 is energized from the middle portion of the fuel discharge stroke. Then, only the fuel (hatched portion A) discharged to the supply passage 35 from the pressurizing chamber 23 during the period Ta in which the solenoid 14 is energized is supplied to the pressure storage chamber 50.

Further, to supply the whole fuel which the high-pressure pump 20 discharges to the pressure storage chamber 50, as indicated by a period Tb for [2] 100% discharge control shown in FIG. 6, the solenoid 14 is energized from the beginning of the fuel discharge stroke. Then, the fuel (hatched portion B) discharged to the supply passage 35 from the pressurizing chamber 23 during the period Tb in which the solenoid 14 is energized is supplied to the pressure storage chamber 50. That is, the maximum amount of fuel which can be discharged by the high-pressure pump 20 is supplied to the pressure storage chamber 50.

To make the fuel supplied to the pressure storage chamber. 50 zero, as indicated by a period for [3] 0% discharge control (however, NE<Nm) shown in FIG. 6, the solenoid 14 is not energized from the beginning to the end of the fuel discharge stroke. Then, the whole fuel discharged from the high-pressure pump 20 is made to return to the inflow passage 30 through the spill passage 39 and hence, the fuel is not supplied to the pressure storage chamber 50.

Next, the discharge flow rate characteristic of the high-pressure pump 20 is explained in conjunction with FIG. 7.

In FIG. 7, the engine rotational speed NE is taken on an axis of abscissas and in case the high-pressure pump 20 is driven in an interlocking manner with a camshaft 24 of the engine 40, usually, the rotational speed NP of the high-pressure pump 20 and the engine rotational speed NE have the relationship NP=NE÷2.

Further, the fuel discharge flow rate QP of the high-pressure pump 20 is taken on an axis of ordinates and the maximum discharge flow rate which can be discharged by the high-pressure pump 20 with respect to the engine rotational speed NE becomes the flow rate at the time of 100% discharge control indicated by a chain line in FIG. 7.

Although the minimum discharge flow rate of the high-pressure pump 20 with respect to the engine rotational speed NE is, as indicated by a solid line in FIG. 7, designed to assume zero irrespective of the engine rotational speed NE, in an actual operation, there may be a case in which the minimum discharge flow rate assumes a flow rate at the time of 0% discharge control indicated by a broken line in FIG. 7.

That is, the minimum discharge flow rate when the engine rotational speed NE is Nm or less can be controlled to zero as designed. However, when the engine rotational speed NE falls in a high speed rotation region of Nm or more, the minimum discharge flow rate is increased larger than zero. For example, when the engine rotational speed NE is Nn (>Nm), the minimum discharge flow rate QP=qn is discharged at minimum. The cause of such a phenomenon is explained hereinafter.

To make the fuel supplied to the pressure storage chamber 50 zero or null, as mentioned previously, the solenoid 14 is not energized from the beginning to the end of the fuel discharge step and the spill valve 12 is in a state that the spill valve 12 is pushed downwardly by the spring force of the spring 13 (FIG. 5A).

Here, the fuel which is discharged into the supply passage 35 from the pressuring chamber 23 flows into the spill passage 39 through the spill valve 12 in the valve opening state, wherein along with the increase of the engine rotational speed NE, the flow speed of the fuel which passes the spill valve 12 is also increased and the maximum pressure which is generated in the inside of the supply passage 35 is gradually increased.

When the maximum pressure in the inside of the supply passage 35 becomes excessively high, a portion of the fuel which the high-pressure pump 20 discharges does not flow into the spill passage 39 and flows out to the pressure storage chamber 50 side. Further, in a worst case, the pressure in the inside of the supply passage 35 overcomes the spring force of the spring 13 which pushes down the spill valve 12 and hence, the spill valve 12 is pushed up whereby, even when the solenoid 14 is not energized, the discharge flow rate control valve 10 assumes the valve closed state. In this manner, when the discharge flow rate control valve 10 is automatically closed in spite of the fact that the solenoid 14 is not energized, as indicated by the period of [4]0% discharge control (here, NE≧Nm) shown in FIG. 6, even when the solenoid 14 is not energized, there is a possibility that the discharged fuel (a hatched portion C in FIG. 6) in the automatically closed period of the discharge flow rate control valve 10 is undesirably supplied to the pressure storage chamber 50.

As a countermeasure to overcome the above-mentioned drawbacks, it may be possible to enlarge a fuel passage area of the spill valve 12 so as to reduce the maximum pressure which is generated in the supply passage 35. However, since this countermeasure requires the remodeling of the discharge flow rate control valve 10, the manufacturing cost is pushed up. Further, it may be also possible to increase the spring force of the spring 13 so as to prevent the automatic closing of the spill valve 12 of the discharge flow rate control valve 10. However, as a drawback of such a countermeasure, the valve-closing response property of the spill valve 12 at the time of performing the normal control is lowered and there exists a possibility that the fuel pressure controllability is worsened. Further, even when the above-mentioned countermeasures are put into practice, it is considered that similar drawbacks will arise when impurities contained in the fuel are stacked on a periphery of the spill valve 12 so that a passage area is narrowed or the spring force of the spring 13 is lowered along with the lapse of time.

The influence which the above-mentioned drawbacks affect the engine is explained in conjunction with the time chart shown in FIG. 8.

FIG. 8 shows the change of various state variables when an accelerator is made to return by a given amount from a state in which the high-load steady state operation (fuel injection flow rate=qf) is performed with the engine rotational speed NE=Nn (>Nm).

Up to a point of time t1 in FIG. 8, a fixed intake air flow rate qa1 which corresponds to a step-in amount apl (a fixed value) of the accelerator pedal 63 is sucked by the engine, while the fuel injection flow rate qf indicated by a solid line which corresponds to the intake air flow rate qa1 is injected from the fuel injection valves 51 and the steady state operation is performed with the engine rotational speed NE=Nn. Here, the pump discharge flow rate which is equal to the fuel injection flow rate qf is discharged by the high-pressure pump 20 and is supplied to the pressure storage chamber 50 so that the fuel pressure PR in the inside of the pressure storage chamber 50 agrees with the target fuel pressure PO.

When the step-in amount of the accelerator pedal 63 is made to return from ap1 to ap2 (<ap1) at the point of time t1, corresponding to the decrease of the intake air flow rate from qa1, the fuel injection flow rate qf is also lowered. As a result, the generated torque of the engine is lowered and the engine rotational speed NE is also gradually lowered. However, compared to the lowering speed of the intake air flow rate, the lowering speed of the engine rotational speed NE is slow due to the inertia of motion of the engine.

When the operation passes the point of time t2, corresponding to the decrease of the intake air flow rate, the fuel injection flow rate is lowered to a value equal to qn or below. Here, although the engine rotational speed NE is slightly lowered, since the engine rotational speed NE is held to the rotational speed which is substantially close to Nn, the discharge flow rate of the high-pressure pump 20 indicated by a broken line is not lowered to approximately qn which is the minimum discharge flow rate when the engine rotational speed NE is approximately Nn. As a result, the fuel injection flow rate becomes smaller than the discharge flow rate of the high-pressure pump 20 so that the fuel pressure PR in the inside of the pressure storage chamber 50 starts elevation against the target fuel pressure PO. Here, the reason that the fuel pressure PR in the pressure storage chamber 50 is elevated is that the fuel discharge flow rate of the high-pressure pump 20 which supplies the fuel to the inside of the pressure storage chamber 50 becomes larger than the fuel injection flow rate which consumes the fuel in the inside of the pressure storage chamber 50 and hence, the fuel charge amount in the inside of the pressure storage chamber 50 is increased.

When the operation reaches the point of time t3, due to the lowering of the engine rotational speed NE, the minimum discharge flow rate of the high-pressure pump 20 becomes gradually lower than the fuel injection flow rate and hence, the increase of the fuel in the inside of the pressure storage chamber 50 is stopped. Then, after the lapse of the point of time t3, it is possible to perform the control such that the minimum discharge flow rate of the high-pressure pump 20 becomes smaller than the fuel injection flow rate and hence, once the fuel amount in the inside of the pressure storage chamber 50 is started to be decreased, the fuel pressure PR is also started to be decreased. Here, after the lapse of the point of time t4, since the engine rotational speed NE becomes NE<Nm, it is possible to control the minimum discharge flow rate of the high-pressure pump 20 to zero and hence, the fuel pressure PR in the inside of the pressure storage chamber 50 is lowered to the target fuel pressure PO.

In this manner, in a state that the discharge flow rate of the high-pressure pump 20 becomes larger than the fuel injection flow rate and hence, the fuel pressure PR is elevated and does not agree with the target fuel pressure PO, the combustion state which is optimum for the engine cannot be obtained whereby the exhaust gas is deteriorated or the fuel pressure PR becomes excessively high whereby the fuel injection valves 51 cannot be driven with the given response property and, in a worst case, there exists the fear of the occurrence of the engine stop.

To overcome the above-mentioned fear, there exists a technique which is proposed in JP-A-2000-303883 (hereinafter referred to as patent literature 1).

In this patent literature 1, in place of the relief valve 37 explained in FIG. 4, an electromagnetic pressure release valve whose open-close operation is controlled by an ECU 60 is adopted, wherein when the fuel pressure PR is to be lowered, the valve opening control of an electromagnetic pressure release valve is performed. However, such a conventional device requires a control system for the electromagnetic pressure release valve and hence, the manufacturing cost is pushed up.

SUMMARY OF THE INVENTION

The present invention has been made in view of the above-mentioned drawbacks of the conventional devices and it is an object of the present invention to provide a fuel injection control device of an internal combustion engine which can prevent the deterioration of an exhaust gas and the occurrence of an engine stop attributed to the lowering of the responsiveness of fuel injection valves by preventing the excessive elevation of a fuel pressure in the inside of a pressure storage chamber even when the minimum discharge flow rate of a high-pressure pump falls in a given rotational speed region which exceeds zero.

Further, it is another object of the present invention to provide a fuel injection control device of an internal combustion engine which can prevent the deterioration of an exhaust gas and the occurrence of an engine stop by preventing the excessive elevation of a fuel pressure in the inside of a pressure storage chamber while ensuring an air-fuel ratio which can maintain a stable combustion state in a given rotational speed region where the minimum discharge flow rate of a high-pressure pump exceeds zero.

(1) The fuel injection control device of an internal combustion engine according to the present invention includes a fuel injection valve which directly injects fuel into the inside of a combustion chamber of an engine, fuel injection valve control means which calculates a basic fuel injection flow rate which becomes a target air-fuel ratio corresponding to an engine operation state and performs a driving control of the fuel injection valve, a pressure storage chamber which is connected to the fuel injection valve and stores fuel of high pressure therein, a fuel pressure sensor which detects a fuel pressure in the inside of the pressure storage chamber, a high-pressure pump which pressurizes the fuel transported from a fuel tank in the inside of a pressurizing chamber and supplies the fuel of high pressure to the pressure storage chamber, a discharge flow rate control valve for controlling a fuel discharge flow rate supplied to the pressure storage chamber from the high-pressure pump, and fuel pressure control means which performs a feedback control of the discharge flow rate control valve such that the fuel pressures in the inside of the pressure storage chamber which is detected by the fuel pressure sensor agrees with a preset target fuel pressure, wherein the fuel injection control device further includes fuel increase correction means which gives an amount increase instruction to the fuel injection control means to increase the basic fuel injection flow rate in a state that a rotational speed of the engine falls in a given preset rotational speed region where the minimum discharge flow rate of the high-pressure pump is expected to exceed zero and the fuel pressure in the inside of the pressure storage chamber is higher than the target fuel pressure.

(2) Further, the present invention is, in the fuel injection control device of an internal combustion engine described in the above-mentioned (1), characterized in that the fuel increase correction means increases the basic fuel injection flow rate when the basic fuel injection flow rate becomes smaller than the minimum discharge flow rate of the high-pressure pump.

(3) Further, the present invention is, in the fuel injection control device of an internal combustion engine described in the above-mentioned (1) or (2), characterized in that an increased amount value set by the fuel increase correction means is set such that the difference between the minimum discharge flow rate of the high-pressure pump and the basic fuel injection flow rate is set as the minimum value.

(4) Further, the present invention is, in the fuel injection control device of an internal combustion engine described in any one of the above-mentioned (1) to (3), characterized in that the increase of fuel by the fuel increase correction means is performed by presetting a limit rich air-fuel ratio which is obtainable by increasing the air-fuel ratio and by limiting the maximum increase amount value of the basic fuel injection flow rate such that the air-fuel ratio does not become richer than the limit rich air-fuel ratio.

(5) Further, the present invention is, in the fuel injection control device of an internal combustion engine described in any one of the above-mentioned (1) to (4), characterized in that an ignition timing when the basic fuel injection flow rate is increased by the fuel increase correction means is changed to an ignition timing which enables the acquisition of an engine generated torque equivalent to an engine generated torque when the basic fuel injection flow rate is not increased by the fuel increase correction means.

(6) Further, the present invention is, in the fuel injection control device of an internal combustion engine described in any one of the above-mentioned (1) to (5), characterized in that the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

According to the fuel injection control device of an internal combustion engine of the present invention, it is possible to prevent the deterioration of the exhaust gas and the occurrence of the engine stop attributed to the lowering of the responsiveness of the fuel injection valve by preventing the excessive elevation of the fuel pressure in the inside of the pressure storage chamber even in the given rotational speed region where the minimum discharge flow rate of the high-pressure pump exceeds zero.

Further, according to the present invention, it is possible to attain the fuel injection control device of an internal combustion engine of the present invention which can prevent the deterioration of the exhaust gas and the occurrence of the engine stop by preventing the excessive elevation of the fuel pressure in the inside of the pressure storage chamber while ensuring the air-fuel ratio which can maintain the stable combustion state even in the given rotational speed region where the minimum discharge flow rate of the high-pressure pump exceeds zero.

BRIEF DESCRIPTION OF THE DRAWINGS

FIG. 1 is a block diagram showing the constitution of a fuel injection control device of an internal combustion engine according to an embodiment 1 of the present invention;

DESCRIPTION OF THE PREFERRED EMBODIMENTS

Embodiment 1

Figure 4:
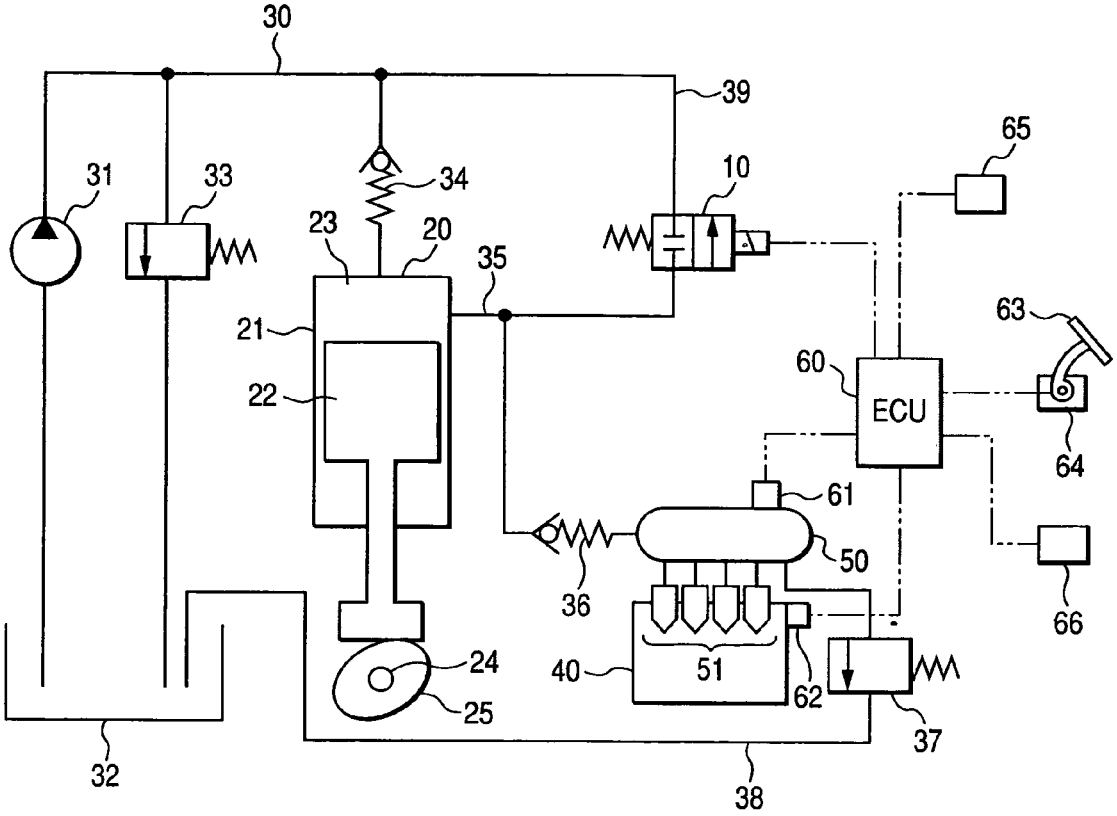
FIG. 4 is a constitutional view showing one example of a fuel supply system of an internal combustion engine which becomes a base of the present invention.
Figure 5A:
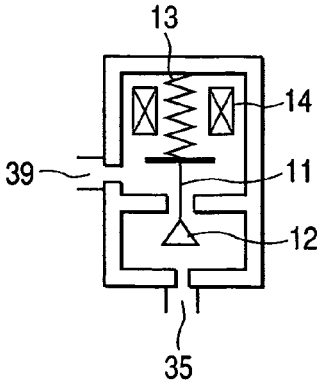
FIGS. 5A–5B are views showing the inner structure of a discharge flow rate control valve.
Figure 5B:
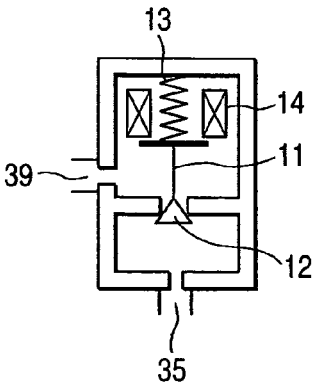
Figure 6:
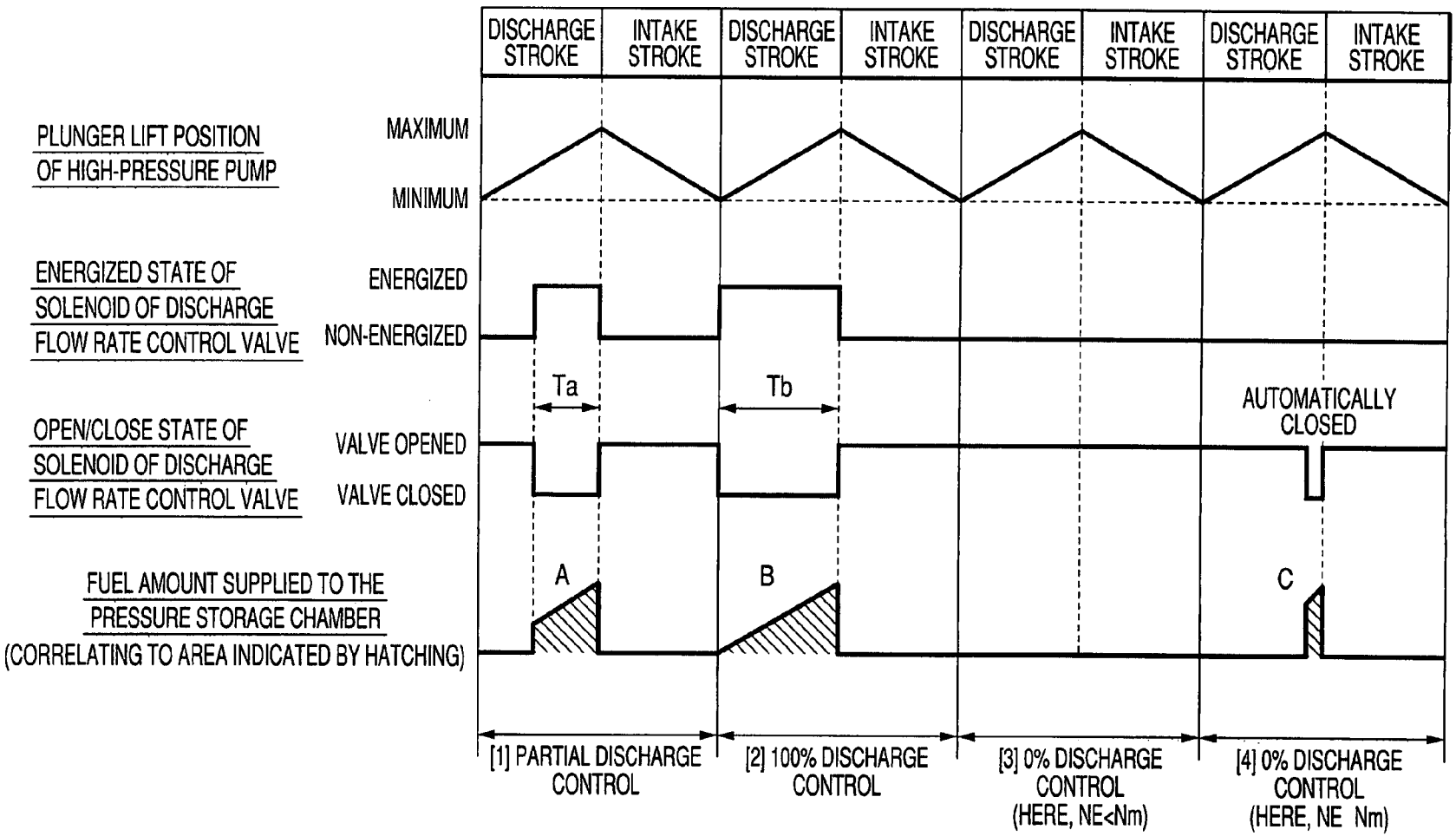
FIG. 6 is an explanatory view showing the relationship between the operation of a discharge flow rate control valve and a fuel amount supplied to a pressure storage chamber.

With respect to a fuel injection control device of an internal combustion engine to which the present invention is applicable, the previously-mentioned constitution of the fuel supply system in conjunction with FIG. 4 is basically directly applicable as it is and hence, the detailed explanation is omitted here.

Hereinafter, the constitution of an ECU 60 which constitutes an electronic control unit of the fuel injection control device according to the embodiment 1 of the present invention is explained in conjunction with a block diagram shown in FIG. 1.

In FIG. 1, based on an engine operation state such as an intake air flow rate detected by an air flow sensor 65, an engine rotational speed NE detected by a rotational speed sensor 62 or a fuel pressure PR in the inside of a pressure storage chamber 50 detected by a fuel pressure sensor 61, fuel injection valve control means 101 calculates a basic fuel injection flow rate Qbase which makes an air-fuel ratio detected by an air-fuel ratio sensor 66 arranged in an exhaust pipe assume a preset target air-fuel ratio and performs a drive control of a fuel injection valve 51.

Fuel pressure control means 105 determines a target fuel pressure PO based on an engine operation state such as the engine rotational speed NE detected by the rotational speed sensor 62 or a step-in amount of an accelerator pedal 63 detected by an accelerator position sensor 64 and, at the same time, performs a feedback control of open-close timing of a discharge flow rate control valve 10 such that the fuel pressure PR in the inside of the pressure storage chamber 50 detected by the fuel pressure sensor 61 agrees with the target fuel pressure PO.

The fuel increase correction means 102 determines whether the engine rotational speed NE detected by the rotational speed sensor 62 is inputted and the operation is under way with the engine rotational speed NE which falls in a given rotational speed region (NE≧Nm) which is expected to make the minimum discharge flow rate of a high-pressure pump exceed zero or not. Further, the fuel increase correction means 102 reads the minimum discharge flow rate of the high-pressure pump 20 determined based on the engine rotational speed NE using the minimum discharge flow rate characteristic stored in a memory of the ECU 60 (see FIG. 7).

On the other hand, the basic fuel injection flow rate Qbase is inputted from the fuel injection valve control means 101 and the fuel increase correction means 102 determines whether the basic fuel injection flow rate Qbase is smaller than the minimum discharge flow rate of the high-pressure pump 20 or not. Further, the fuel increase correction means 102 compares the fuel pressure PR detected by the fuel pressure sensor 61 and the target fuel pressure PO calculated by the fuel control means 105 and determines whether the fuel pressure PR is in a state that the fuel pressure PR is higher than the target fuel pressure PO or not.

Here, in a state that the engine rotational speed NE falls in the given rotational speed region (NE≧Nm) which is expected to make the minimum discharge flow rate of a high-pressure pump exceed zero and the basic fuel injection flow rate Qbase is smaller than the minimum discharge flow rate of the high-pressure pump 20, and the fuel pressure PR in the inside of the pressure storage chamber 50 becomes higher than the target fuel pressure PO, the fuel increase correction means 102 instructs the fuel injection valve control means 101 to increase the basic fuel injection flow rate Qbase by a given amount Qadd.

The fuel injection valve control means 101, based on this instruction, increases the basic fuel injection flow rate Qbase by a given amount Qadd and performs a driving control of the fuel injection valve 51 with the final injection flow rate Qfin=(Qbase+Qadd).

Here, with respect to the increased amount value Qadd given by the fuel increase correction means 102, the difference between the minimum discharge flow rate of the high-pressure pump 20 and the basic fuel injection flow rate Qbase is set as the minimum value.

Further, a limit rich air-fuel ratio which is obtainable by increasing the air-fuel ratio is preliminarily determined for every engine operation state and the final injection flow rate Qfin which is limited by the maximum injection flow rate Qltd which prevents the air-fuel ratio from becoming richer than the limit rich air-fuel ratio is instructed to the fuel injection valve control means 101.

Further, the fuel increase correction means 102 instructs the final injection flow rate Qfin to the fuel injection valve control means 101 and, at the same time, transmits an ignition timing change instruction to ignition timing control means 103 such that an engine generated torque equivalent to an engine generated torque when the basic fuel injection flow rate Qbase is not increased can be obtained, and an ignition coil 104 is driven at the instructed ignition timing.

Further, the exhaust temperature TE which is detected by the exhaust temperature sensor 67 arranged in the exhaust pipe of the engine is inputted to the fuel increase correction means 102 and the fuel increase correction means 102 estimates a catalyst temperature based on the exhaust temperature TE and inhibits the above-mentioned fuel increase control when the estimated catalyst temperature exceeds a given temperature.

Here, in this embodiment 1, although the explanation is made with respect to the example in which the catalyst temperature is estimated using the exhaust temperature sensor 67 which directly detects the exhaust temperature TE, it may be possible to adopt an example in which the catalyst temperature for each engine operation state is measured experimentarily and the catalyst temperature obtained by the experiment is preliminarily stored in a memory of an ECU and is used as an estimated catalyst temperature.

Figure 2:
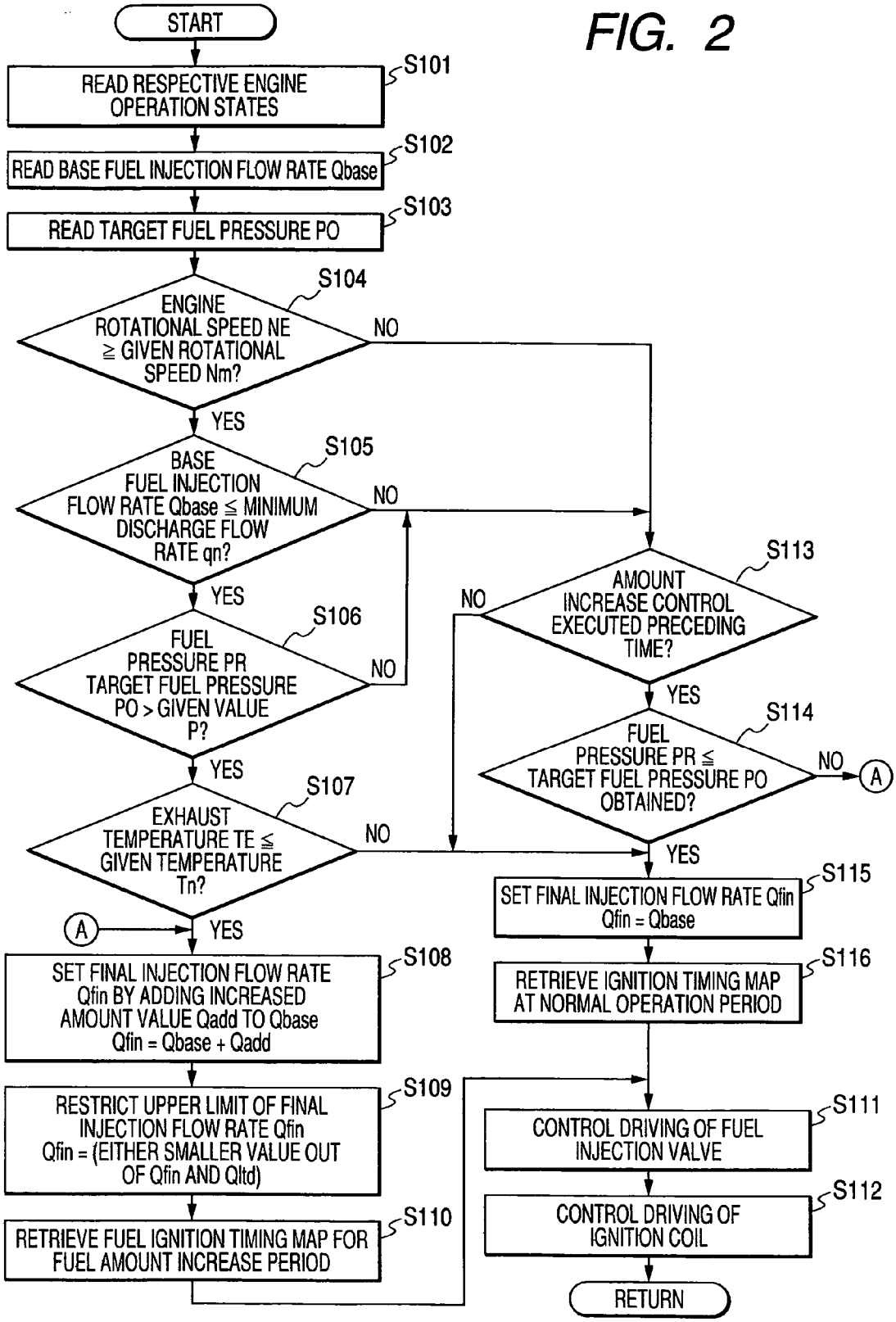
FIG. 2 is a flow chart showing control operations of a fuel injection control device of an internal combustion engine according to an embodiment 1 of the present invention.

Next, the control operation of the fuel increase correction means 102 is explained in conjunction with a flow chart shown in FIG. 2.

First of all, in step S101, the fuel increase correction means 102 reads various engine state variables such as the engine rotational speed NE detected by the rotational speed sensor 62, the fuel pressure PR in the inside of the pressure storage chamber 50 detected by the fuel pressure sensor 61, the exhaust temperature TE detected by the exhaust temperature sensor 67 and the like, and in step S102, reads the basic fuel injection flow rate Qbase calculated by the fuel injection valve control means 101, and in step S103, reads the target fuel pressure PO determined by the fuel control means 105. Then, the processing advances to step S104.

In step S104, the fuel increase correction means 102 compares the engine rotational speed NE read in step S101 and the given rotational speed Nm with which the minimum discharge flow rate of the high-pressure pump is expected to exceed zero.

In step S104, when the determination is negative (engine rotational speed NE<given rotational speed Nm), the processing advances to step S113. In step S113, the fuel increase correction means 102 determines whether the fuel increase control is performed immediately before or not. In this case, the determination is made negative (the fuel increase control being not performed immediately before) and the processing advances to step S115. In step S115, the basic fuel injection flow rate Qbase is set as the final injection flow rate Qfin with which the driving control is performed on the fuel injection valve 51. The processing advances to step S116 where the fuel increase correction means 102 retrieves the ignition timing using the ignition timing map for usual time and the processing advances to step S111. Then, in step S111, the fuel increase correction means 102 performs the driving control of the fuel injection valve 51 with the final injection flow rate Qfin=Qbase which is set in step S115. In next step S112, the driving control of the ignition coil 104 is performed at the ignition timing of the usual time retrieved in step S116 and the processing in step S116 is finished.

On the other hand, when the determination is affirmative (engine rotational speed NE≧given rotational speed Nm) in step S104, the processing advances from step S104 to step S105.

Figure 7:
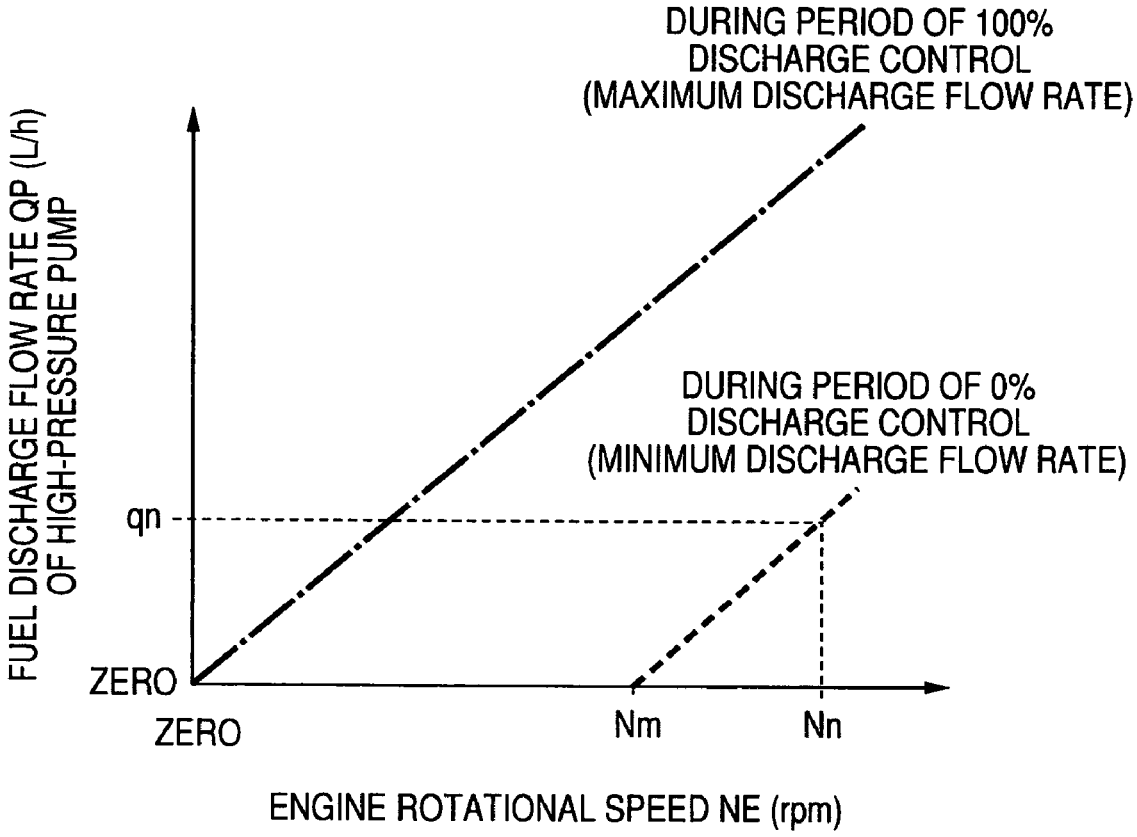
FIG. 7 is a discharge flow rate characteristic chart of a high-pressure pump.
Figure 8:
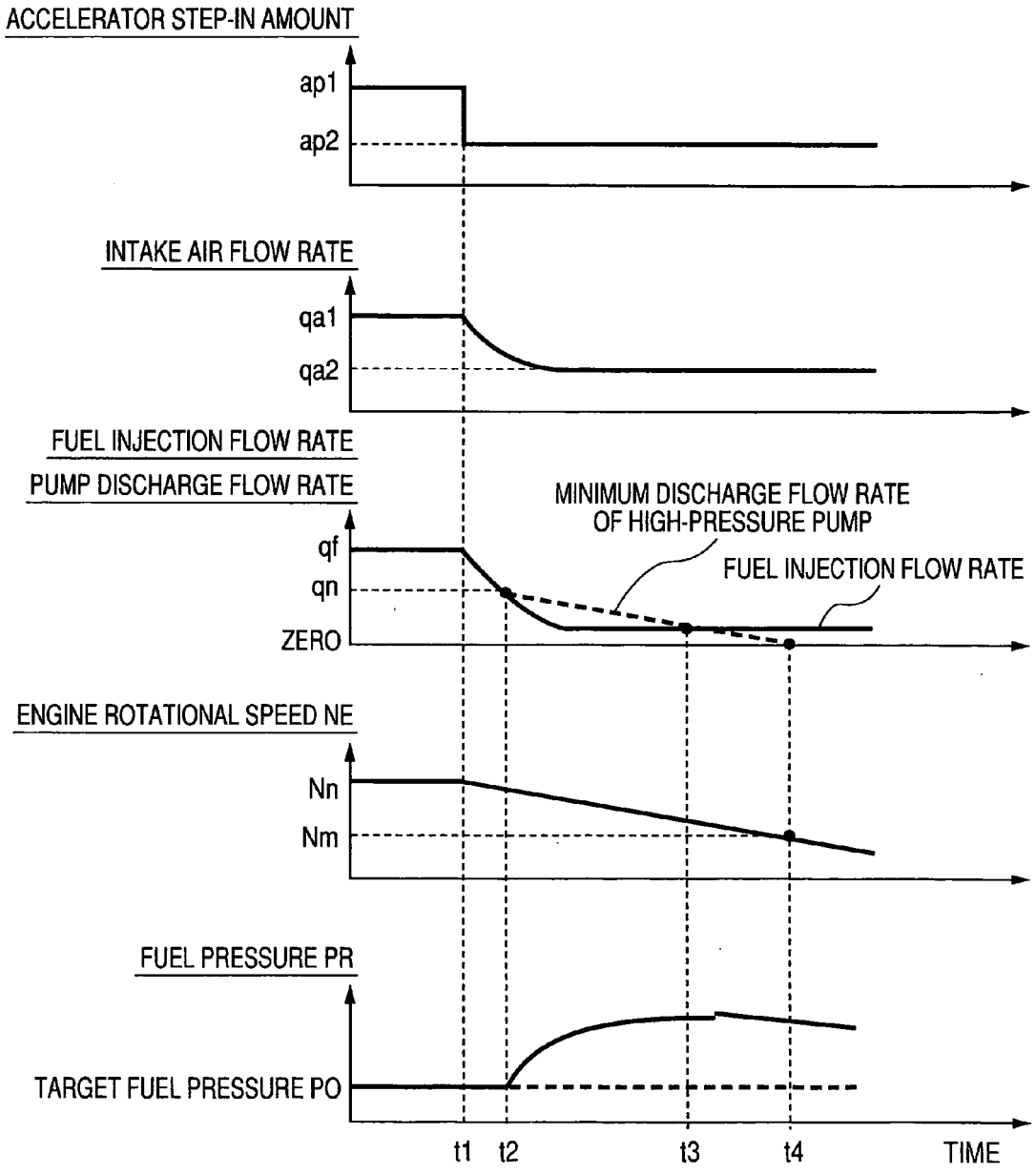
FIG. 8 is a timing chart showing the change of various state variables of a fuel supply system in a conventional device.

In step S105, fuel increase correction means 102 calculates the minimum discharge flow rate qn of the high-pressure pump 20 at this point of time based on engine rotational speed NE read in step S101 and the discharge flow rate characteristic shown in FIG. 7 and compares the basic fuel injection flow rate Qbase read in step S102 and the minimum discharge flow rate qn.

When the determination is negative (basic fuel injection flow rate Qbase>minimum discharge flow rate qn of high-pressure pump 20) in step S105, the processing advances to step S113. In step S113, the fuel increase correction means 102 determines whether the fuel increase control is performed immediately before or not. In this case, the determination is made negative (the fuel increase control being not performed immediately before) and the processing advances to step S115. In step S115, the basic fuel injection flow rate Qbase is set as the final injection flow rate Qfin with which the driving control is performed on the fuel injection valve 51. The processing advances to next step S116 where the fuel increase correction means 102 retrieves the ignition timing using the ignition timing map for usual time and the processing advances to step S111. Then, in step S111, the fuel increase correction means 102 performs the driving control of the fuel injection valve 51 with the final injection flow rate Qfin=Qbase which is set in step S115. In next step S112, the driving control of the ignition coil 104 is performed at the ignition timing of the usual time retrieved in step S116 and the processing in step S116 is finished.

On the other hand, when the determination is affirmative (basic fuel injection flow rate Qbase≧minimum discharge flow rate qn of high-pressure pump 20) in step S105, the processing advances to step S106 from step S105. In step S106, the fuel increase correction means 102 compares the fuel pressure deviation (fuel pressure PR—target fuel pressure PO) between the fuel pressure PR in the inside of the pressure storage chamber 50 detected by the fuel pressure sensor 61 which is read in step S101 and the target fuel pressure PO read in step S103 with a given value ΔP.

When the determination is negative (fuel pressure PR—target fuel pressure PO≦given value ΔP) in step S106, the processing advances to step S113. In step S113, the fuel increase correction means 102 determines whether the fuel increase control is performed immediately before or not. In this case, the determination is made negative (the fuel increase control being not performed immediately before) and the processing advances to step S115. In step S115, the basic fuel injection flow rate Qbase is set as the final injection flow rate Qfin with which the driving control is performed on the fuel injection valve 51. The processing advances to step S116 where the fuel increase correction means 102 retrieves the ignition timing using the ignition timing map for usual time and the processing advances to step S111. Then, in step S111, the fuel increase correction means 102 performs the driving control of the fuel injection valve 51 with the final injection flow rate Qfin=Qbase which is set in step S115. In next step S112, the driving control of the ignition coil 104 is performed at the ignition timing of the usual time retrieved in step S116 and the processing in step S116 is finished.

On the other hand, when the determination is affirmative (fuel pressure PR—target fuel pressure PO>given value ΔP) in step S106, the processing advances to step S107 from the step S106. In step S107, the fuel increase correction means 102 compares the exhaust temperature TE detected by the exhaust temperature sensor 67 read in step S101 with the catalyst temperature (preset given temperature Tn) which damages the catalytic performance.

In step S107, when the determination is negative (exhaust temperature TE>given temperature Tn), the processing advances to step S115. In step S115, the basic fuel injection flow rate Qbase is set as the final injection flow rate Qfin with which the driving control is performed on the fuel injection valve 51. The processing advances to step S116 where the fuel increase correction means 102 retrieves the ignition timing using the ignition timing map for usual time and the processing advances to step S111. Then, in step S111, the fuel increase correction means 102 performs the driving control of the fuel injection valve 51 with the final injection flow rate Qfin=Qbase which is set in step S115. In next step S112, the driving control of the ignition coil 104 is performed at the ignition timing of the usual time retrieved in step S116 and the processing in step S116 is finished.

On the other hand, in step S107, when the determination is affirmative (exhaust temperature TE≦given temperature Tn), the processing advances to step S108 from step S107. In step S108, the increased amount value Qadd is added to the basic fuel injection flow rate Qbase read in step S102 and Qbase+Qadd is set as the final injection flow rate Qfin with which the driving control of the fuel injection valve 51 is performed and the processing advances to step S109. Here, as the increased amount value Qadd, at least a value which is equal to or larger than the difference between the minimum discharge flow rate qn of the high-pressure pump 20 and the basic fuel injection flow rate Qbase is set.

In the next step S109, an upper limit of the final injection flow rate Qfin=Qbase+Qadd which is set in step S108 is restricted such that the final injection flow rate Qfin does not become richer than a limit rich air-fuel ratio which can be made rich and the processing advances to step S110.

Here, as one example of a method for restricting the upper limit is, for example, assuming the present intake air flow rate as Qa, the limit rich air-fuel ratio which can be made rich as AF, the upper limit value of the final injection flow rate Qfin as Qltd, the upper limit value Qltd of the final injection flow rate Qfin which becomes Qltd<Qa÷AF is obtained and when the final injection flow rate Qfin set in step S108 exceeds the above-mentioned upper limit value Qltd, the final injection flow rate Qfin is restricted as the final injection flow rate Qfin=Qltd.

In step S110, the ignition timing is retrieved based on the ignition timing map used in the fuel increase control of the fuel injection flow rate and, in next step S111, the driving control of the fuel injection valve 51 is performed using the final injection flow rate Qfin=Qbase+Qadd (however, Qfin being restricted to a value equal to or less than Qltd at maximum) which is increased in step S109. In next step S112, the driving control of the ignition coil 104 is performed with the ignition timing used when the fuel injection flow rate which is retrieved in step S110 is increased and the processing of the step 112 is finished.

When the processing advances from step S104, step S105 or step S106 to step S113 due to the negative determination immediately after the fuel increase control is executed, the affirmative determination (assuming that the fuel increase control is made immediately before) is made in step S113 and the processing advances to step S114. In step S114, the fuel increase correction means 102 determines whether the fuel pressure PR assumes a value equal to or below the target fuel pressure PO or not. That is, the fuel increase correction means 102 determines whether the fuel pressure PR is lowered to the target fuel pressure PO due to the fuel increase control or not.

In step S114, when the determination is negative (fuel pressure PR>target fuel pressure PO), it is determined that the fuel pressure PR is not yet lowered to the target fuel pressure PO and hence, the processing advances from S114 to step S108 and the processing for fuel increase control successively ranging from step S108 to step S112 is finished.

On the other hand, in step S114, when the determination is affirmative (fuel pressure PR≦target fuel pressure PO), it is determined that the fuel pressure PR has been completely lowered to the target fuel pressure PO due to the fuel increase control of the preceding time and hence, the processing advances from S114 to step S115 and the basic fuel injection flow rate Qbase is set as the final injection flow rate Qfin for performing the driving control of the fuel injection valve 51. Then, the processing advances to next step S116 in which the fuel increase correction means 102 retrieves the ignition timing based on the ignition timing map for usual time and, then, the processing advances to step S111. In step S111, the driving control of the fuel injection valve 51 is performed using the final injection flow rate Qfin=Qbase which is set in step S115. In next step S112, the driving control of the ignition coil 104 is performed with the ignition timing in usual time which is retrieved in step S116 and the processing of the step 112 is finished.

Figure 3:
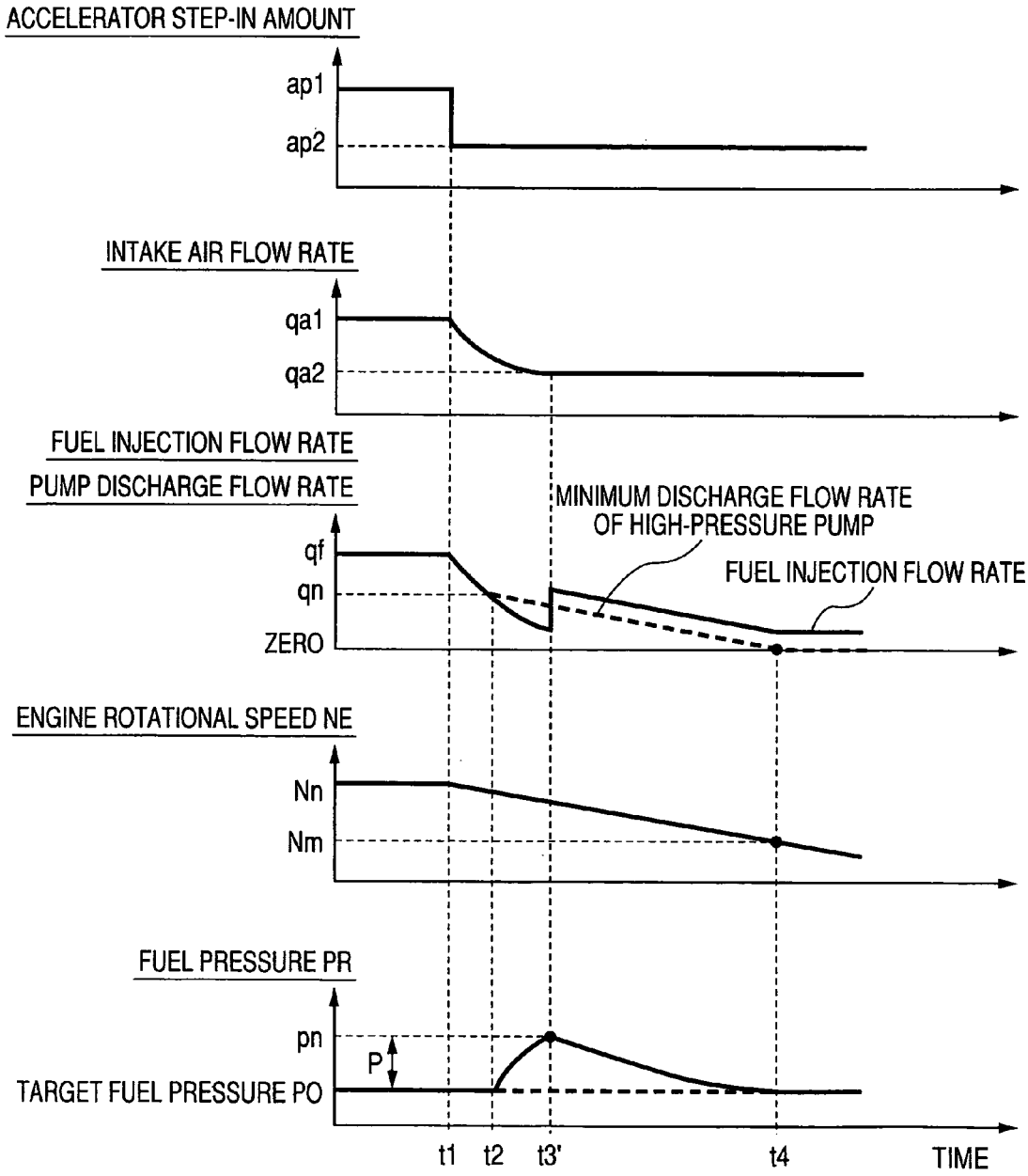
FIG. 3 is a timing chart showing one example of various state variables of a fuel supply system when a fuel injection control device of an internal combustion engine according to an embodiment 1 of the present invention is used.

FIG. 3 is a timing chart showing one example of change of various state variables of a fuel supply system when the fuel injection control device of an internal combustion engine according to the embodiment 1 which has been explained heretofore is used.

FIG. 3 shows the change of various state variables when the accelerator is returned by a given amount from a state in which the high load steady state operation (fuel injection flow rate=qf) is performed with the engine rotational speed NE=Nn (>Nm).

In FIG. 3, until the point of time t1, a fixed intake air flow rate qa1 which corresponds to a step-in amount apl (fixed value) of the accelerator pedal 63 is taken into the engine, and a fuel injection flow rate qf indicated by a solid line which corresponds to the intake air flow rate gal is injected from the fuel injection valve 51 and the steady state operation is performed with the engine rotational speed NE=Nn. Here, a pump discharge flow rate equal to the fuel injection flow rate qf is injected from the high-pressure pump 20 and is supplied to the pressure storage chamber 50, wherein the fuel pressure PR in the pressure storage chamber 50 agrees with the target fuel pressure PO.

When the step-in amount of the accelerator pedal 63 is returned from ap1 to ap2 (<ap1) at the point of time t1, the fuel injection flow rate is also lowered from qf corresponding to the lowering of the intake air flow rate from qa1. As a result, the generated torque of the engine is lowered and hence, the engine rotational speed NE is also gradually lowered. However, compared to the lowering speed of the above-mentioned intake air flow rate, the lowering speed of the engine rotational speed NE is gentle due to the inertia of motion of the engine.

When the point of time t2 lapses, the fuel injection flow rate is lowered to qn or less corresponding to the decrease of the intake air flow rate. Here, although the engine rotational speed NE is slightly lowered, the engine rotational speed NE is substantially held at the rotational speed close to Nn and hence, the discharge flow rate of the high-pressure pump 20 indicated by a broken line is not lowered to approximately qn which is the minimum discharge flow rate when the engine rotational speed NE is approximately Nn. As a result, the fuel injection flow rate becomes smaller than the discharge flow rate of the high-pressure pump 20 and hence, the fuel pressure PR in the inside of the pressure storage chamber 50 starts to be elevated against the target fuel pressure PO.

Thereafter, at the point of time t3', the ECU 60 determines that the engine rotational speed NE is higher than the given rotational speed Nm at which the minimum discharge flow rate of the high-pressure pump assumes a state which exceeds zero, the fuel injection flow rate is smaller than the minimum discharge flow rate of the high-pressure pump, and the fuel pressure PR in the inside of the pressure storage chamber 50 assumes pn which is higher than the target fuel pressure PO by ΔP whereby the fuel increase correction of the fuel injection flow rate is made such that the fuel injection flow rate becomes larger than the minimum discharge flow rate of the high-pressure pump.

When the fuel increase correction of the fuel injection flow rate is performed at the point of time t3', the minimum discharge flow rate of the high-pressure pump 20 becomes smaller than the fuel injection flow rate and hence, the increase of the fuel in the pressure storage chamber 50 is stopped.

Then, after the point of time t3' lapses, the fuel amount in the inside of the pressure storage chamber 50 is rapidly decreased so that the fuel pressure PR in the inside of the pressure storage chamber 50 is also rapidly lowered.

Then, different from the prior art, at the point of time t4, the fuel pressure PR in the inside of the pressure storage chamber 50 and the target fuel pressure PO agree with each other and hence, compared with the prior art, it is possible to achieve the prevention of the sharp elevation of the fuel pressure and the rapid lowering of the elevated fuel pressure whereby the deterioration of the exhaust gas and the occurrence of engine stop which have been considered as the drawbacks of the prior art can be suppressed as much as possible.

As has been explained heretofore, according to the fuel injection control device of the embodiment 1 of the present invention, the fuel injection control device includes fuel increase correction means which can increase the basic fuel injection flow rate when a state that a rotational speed of the engine falls in a given rotational speed region where the minimum discharge flow rate of the high-pressure pump exceeds zero and the fuel pressure PR in the inside of the pressure storage chamber is higher than the target fuel pressure PO is continued. Accordingly, it is possible to prevent the extreme elevation of the fuel pressure in the inside of the pressure storage chamber whereby the deterioration of the exhaust gas and the occurrence of the engine stop attributed to the lowering of the responsiveness of the fuel injection valve can be prevented.

Further, the increased amount value set by the fuel increase correction means is set such that the difference between the minimum discharge flow rate of the high-pressure pump and the basic fuel injection flow rate is set as the minimum value. Further, the limit rich air-fuel ratio which is obtainable by increasing the air-fuel ratio is preliminarily set and the maximum increase amount value of the basic fuel injection flow rate is limited such that the air-fuel ratio does not become richer than the limit rich air-fuel ratio. Accordingly, it is possible to prevent the excessive elevation of fuel pressure in the inside of the pressure storage chamber while ensuring the air-fuel ratio which can maintain the stable combustion state.

Further, the ignition timing is changed at the time of increasing the basic fuel injection flow rate so as to obtain the engine generated torque which is substantially equal to the engine generated torque which is obtained when the basic fuel injection flow rate is not increased. Accordingly, at the time of decelerating the engine, it is possible to prevent the excessive elevation of fuel pressure in the inside of the pressure storage chamber while ensuring the drivablity which gives no discomfort to an occupant.

Further, when the temperature of the catalyst which is arranged in the pipe of the engine exceeds the given preset temperature, the increase of the basic injection flow rate by the fuel increase correction means is inhibited so that it is possible to obviate the elevation of the catalyst temperature which damages the catalytic performance.

What is claimed is:

1. A fuel injection control device of an internal combustion engine comprising:

a fuel injection valve which directly injects fuel into the inside of a combustion chamber of an engine;

fuel injection valve control means which calculates a basic fuel injection flow rate which becomes a target air-fuel ratio corresponding to an engine operation state and performs a driving control of the fuel injection valve;

a pressure storage chamber which is connected to the fuel injection valve and stores fuel of high pressure therein;

a fuel pressure sensor which detects a fuel pressure in the inside of the pressure storage chamber;

a high-pressure pump which pressurizes the fuel transported from a fuel tank in the inside of a pressurizing chamber and supplies the fuel of high pressure to the pressure storage chamber;

a discharge flow rate control valve for controlling a fuel discharge flow rate supplied to the pressure storage chamber from the high-pressure pump; and fuel pressure control means which performs a feedback control of the discharge flow rate control valve such that the fuel pressure in the inside of the pressure storage chamber which is detected by the fuel pressure sensor agrees with a preset target fuel pressure, wherein the fuel injection control device includes fuel increase correction means which gives an amount increase instruction to the fuel injection control means to increase the basic fuel injection flow rate in a state that a rotational speed of the engine falls in a given preset rotational speed region where the minimum discharge flow rate of the high-pressure pump is expected to exceed zero and the fuel pressure in the inside of the pressure storage chamber is higher than the target fuel pressure.

2. A fuel injection control device of an internal combustion engine according to claim 1, wherein the fuel increase correction means increases the basic fuel injection flow rate when the basic fuel injection flow rate becomes smaller than the minimum discharge flow rate of the high-pressure pump.

3. A fuel injection control device of an internal combustion engine according to claim 2, wherein an increased amount value set by the fuel increase correction means is set such that the difference between the minimum discharge flow rate of the high-pressure pump and the basic fuel injection flow rate is set as the minimum value.

4. A fuel injection control device of an internal combustion engine according to claim 1, wherein the increase of fuel by the fuel increase correction means is performed by presetting a limit rich air-fuel ratio which is obtainable by increasing the air-fuel ratio and by limiting the maximum increase amount value of the basic fuel injection flow rate such that the air-fuel ratio does not become richer than the limit rich air-fuel ratio.

5. A fuel injection control device of an internal combustion engine according to claim 2, wherein the increase of fuel by the fuel increase correction means is performed by presetting a limit rich air-fuel ratio which is obtainable by increasing the air-fuel ratio and by limiting the maximum increase amount value of the basic fuel injection flow rate such that the air-fuel ratio does not become richer than the limit rich air-fuel ratio.

6. A fuel injection control device of an internal combustion engine according to claim 3, wherein the increase of fuel by the fuel increase correction means is performed by presetting a limit rich air-fuel ratio which is obtainable by increasing the air-fuel ratio and by limiting the maximum increase amount value of the basic fuel injection flow rate such that the air-fuel ratio does not become richer than the limit rich air-fuel ratio.

7. A fuel injection control device of an internal combustion engine according to claim 1, wherein an ignition timing when the basic fuel injection flow rate is increased by the fuel increase correction means is changed to an ignition timing which enables the acquisition of an engine generated torque equivalent to an engine generated torque when the basic fuel injection flow rate is not increased by the fuel increase correction means.

8. A fuel injection control device of an internal combustion engine according to claim 2, wherein an ignition timing when the basic fuel injection flow rate is increased by the fuel increase correction means is changed to an ignition timing which enables the acquisition of an engine generated torque equivalent to an engine generated torque when the basic fuel injection flow rate is not increased by the fuel increase correction means.

9. A fuel injection control device of an internal combustion engine according to claim 3, wherein an ignition timing when the basic fuel injection flow rate is increased by the fuel increase correction means is changed to an ignition timing which enables the acquisition of an engine generated torque equivalent to an engine generated torque when the basic fuel injection flow rate is not increased by the fuel increase correction means.

10. A fuel injection control device of an internal combustion engine according to claim 4, wherein an ignition timing when the basic fuel injection flow rate is increased by the fuel increase correction means is changed to an ignition timing which enables the acquisition of an engine generated torque equivalent to an engine generated torque when the basic fuel injection flow rate is not increased by the fuel increase correction means.

11. A fuel injection control device of an internal combustion engine according to claim 6, wherein an ignition timing when the basic fuel injection flow rate is increased by the fuel increase correction means is changed to an ignition timing which enables the acquisition of an engine generated torque equivalent to an engine generated torque when the basic fuel injection flow rate is not increased by the fuel increase correction means.

12. A fuel injection control device of an internal combustion engine according to claim 1, wherein the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

13. A fuel injection control device of an internal combustion engine according to claim 2, wherein the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

14. A fuel injection control device of an internal combustion engine according to claim 3, wherein the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

15. A fuel injection control device of an internal combustion engine according to claim 4, wherein the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

16. A fuel injection control device of an internal combustion engine according to claim 7, wherein the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

17. A fuel injection control device of an internal combustion engine according to claim 10, wherein the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

18. A fuel injection control device of an internal combustion engine according to claim 11, wherein the fuel injection control device includes catalyst temperature detection means which detects a temperature of a catalyst arranged in an exhaust pipe of the engine, and inhibits the increase of the basic fuel injection flow rate by the fuel increase correction means when the detected temperature of the catalyst exceeds a preset given temperature.

* * * * *